US005776309A

United States Patent [19]

Fraik

[11] Patent Number: 5,776,309

[45] Date of Patent: Jul. 7, 1998

[54] METHOD AND APPARATUS FOR MEASURING AND CONTROLLING THE SPEED OF PAPERMAKING FABRICS

[75] Inventor: Robert D. Fraik, Marinette, Wis.

[73] Assignee: Badger Paper Mills, Inc., Pestigo, Wis.

[21] Appl. No.: 785,328

[22] Filed: Jan. 21, 1997

[51] Int. Cl.[6] ..... D21F 11/00; D21F 7/08

[52] U.S. Cl. ..... 162/198; 162/252; 162/263; 162/DIG. 10; 364/471.01

[58] Field of Search ..... 162/252, 262, 162/263, 348, 358.1, DIG. 10, 257, 198; 364/471.01, 471.02, 471.03

[56] References Cited

U.S. PATENT DOCUMENTS

| | | |
|---|---|---|
| 3,104,997 | 9/1963 | Stewart et al. . |
| 3,437,823 | 4/1969 | Joyce . |
| 3,970,489 | 7/1976 | Schmidt et al. . |
| 4,087,320 | 5/1978 | Danahy et al. . |
| 4,496,428 | 1/1985 | Wells . |
| 4,879,000 | 11/1989 | Gausa . |
| 4,918,522 | 4/1990 | Pajunen . |
| 4,932,320 | 6/1990 | Brunetti et al. . |
| 5,341,824 | 8/1994 | Fletcher et al. . |
| 5,393,378 | 2/1995 | Yakabe et al. . |
| 5,403,447 | 4/1995 | Jarvinen et al. . |
| 5,472,571 | 12/1995 | Niemi . |
| 5,572,433 | 11/1996 | Falconer et al. . |

OTHER PUBLICATIONS

Brochure by Dantec Measurement Technology, Inc. entitled "Better Paper Machine Economics Using Sensor Line®", publication date unknown but prior to 1997.

*Primary Examiner*—Peter Chin
*Assistant Examiner*—Steven B. Leavitt
*Attorney, Agent, or Firm*—Foley & Lardner

[57] ABSTRACT

An endless loop of fabric of the type used in papermaking is provided with a row of optically detectable marks aligned in the direction of motion of the fabric. A beam of light pulses from a strobe light is directed to a position on the fabric through which the row of marks passes and the position of the marks as illuminated by the strobe light is observed. When the observed marks are stationary, the speed of the fabric can be determined based on the frequency of the light pulses from the strobe light and the spacing between the marks on the fabric. The speed of the fabric can be controlled to a desired speed by setting the strobe pulse frequency and adjusting a variable speed drive for the motor driven rollers driving the fabric until the marks as illuminated by the strobe light appear stationary. Variations in the speed of the fabric result in variations of the position of the marks as illuminated by the strobe light, allowing equipment problems causing the speed variations to be diagnosed. The speed of the fabric can also be controlled by detecting the position of the marks as illuminated by the strobe light to provide control signals to a roller drive to speed up or slow down the rollers until the positions of the illuminated marks become stationary.

14 Claims, 3 Drawing Sheets

METHOD AND APPARATUS FOR MEASURING AND CONTROLLING THE SPEED OF PAPERMAKING FABRICS

FIELD OF THE INVENTION

This invention pertains generally to the field of papermaking and particularly to the measurement and control of the speed of web contacting fabrics used in papermaking, including forming wires and felts.

BACKGROUND OF THE INVENTION

In commercial paper making processes, the paper fibers are deposited from a pulp slurry onto a Fourdrinier forming wire which supports the deposited fibers to allow formation of the continuous paper web. The forming wire is an endless loop of wire screen which is supported by rollers that are driven to move the forming wire. In the processing of the formed web, the web may be transferred to other support wires or felts and the web may be engaged by press felts, all of which are similarly endless loops that are supported and driven by rollers. Similar forming wires or felts are used in air-laid papermaking. These various types of flexible forming wires, felts, etc. used in papermaking will be referred to herein as web contact fabrics.

It is usually necessary to closely control the speed of the fabric during papermaking to ensure the uniformity of web thickness and strength and other qualities of the final paper product. In typical commercial papermaking machines, the speed of the fabric is ascertained by using a tachometer or other speed sensor connected to one or more of the support rollers for the fabric. The speed of rollers has also been measured by the use of a strobe light synchronized to illuminate a bolt on the roller surface, with the strobe pulse frequency then indicating the frequency of rotation of the roller. The assumption is made that the speed of the fabric corresponds to the surface speed of the roller or rollers driving and supporting the fabric. This assumption is not necessarily warranted. Quite often, the fabric will slip relative to the surface of the rollers, so that the speed of the rollers as measured by the tachometer does not accurately represent the speed of the fabric. A problem can particularly arise where more than one roller is being driven. Differences in the surface speeds of the driven rollers can result in "pulsing" of the fabric speed and intermittent slipping of the fabric with respect to the rollers. Such speed variations may occur over relatively short periods of time, and the average speed of the fabric may remain constant. These speed variations can result in aberrations in the characteristics and the quality of the paper being produced and accelerated wear of the fabric.

One conventional approach to diagnosing and controlling the problem of fabric speed variation is to utilize a tachometer connected to a small roller which is directly engaged against the surface of the fabric so that the tachometer, in theory, directly measures the speed of the fabric. However, the small roller of the tachometer can itself slip with respect to the fabric so that the measured speed of the roller does not necessarily correspond to the actual speed of the fabric. The roller itself may also interfere with the formation of the web on the fabric. Other approaches to the problem have attempted to measure the speed of the paper web itself, such as by measuring patterns in the paper as detected by optical detectors. These approaches typically require complex and expensive equipment, and are subject to measurement errors because of irregularities in the characteristics of the paper and the general difficulty of separating the desired signals from noise picked up by the detectors.

SUMMARY OF THE INVENTION

In accordance with the invention, a robust and reliable technique is provided for the measurement of web contact fabric speed that can be implemented using simple and inexpensive equipment. The fabric speed is measured substantially continuously to allow transient or periodic changes in fabric speed to be detected, facilitating the diagnosis of papermaking machine problems. The measurement process can be entirely automated, including feedback control of the rollers driving the fabric. The speed measurement is precise and unambiguous, and is essentially immune to noise.

In the present invention, the web contact fabric is provided with uniformly spaced optically detectable marks that extend in row along the length of the fabric loop, aligned in the direction of fabric motion. These marks may be placed adjacent to an edge (or both edges) of the upper or outer surface of the fabric (a surface which engages the web) or at the edge or at various other places on the lower or inner surface of the fabric (the surface opposite that which contacts the web). The marks are aligned in a row so that they move in a straight path as the fabric moves. A strobe light is positioned to provide a beam of pulses of light that are directed at the marks. An observer may watch the marks as illuminated by the strobe light, either directly or as displayed on a video monitor connected to a video camera positioned to observe the marks illuminated by the strobe light. The pulse frequency of the strobe light can be adjusted until the marks observed become stationary. The speed of the fabric at this point can be determined by multiplying the strobe pulse frequency times the spacing between the marks. The operator can also adjust the speed of the rollers driving the fabric to change the speed of the fabric so that the observed marks become stationary at a selected pulse frequency of the strobe light. If the observer sees that the mark as illuminated by the strobe light drifts forwardly or backwardly, a change in the speed of the moving fabric is indicated. Slippage of the fabric with respect to the drive rollers or periodic (harmonic) variations in fabric speed due to, e.g., differences in the speeds of multiple drive rollers will be clearly manifested as the observed position of the illuminated mark(s) changes. Even very small or intermittent changes in fabric speed can be detected in this manner. The average or nominal speed of the fabric can also be set and controlled using the invention. For example, the observer can set the strobe light pulse frequency to a selected frequency corresponding to the desired fabric speed and then adjust the speed of an adjustable drive for the rollers so that the observed marks are brought to a stationary position.

The control of fabric speed in accordance with the invention may be implemented automatically by utilizing an optical detector, such as a video camera, to detect the position of the marks illuminated by the strobe light and an automatic controller to adjust the pulse frequency of the strobe light and/or the speed of the roller drive until the marks illuminated by the strobe light become stationary. The optical detector can also detect drifting of the illuminated marks forwardly or backwardly and provide signals to the drive for the rollers to adjust the roller drive speed, either to increase or decrease the drive speed, to maintain the illuminated marks in a stationary position.

The present invention requires no special modification to the papermaking equipment itself. The marks on the fabric may be placed on existing papermaking fabrics using various types of permanent markers. For example, a template with regularly spaced openings corresponding to the spacing of the marks may be placed against a surface of the fabric and the marks placed upon the fabric by applying ink or paint to the fabric through the openings in the template. The template may then be moved to a next position along the fabric and a similar set of marks placed upon the fabric. Because the marks may be placed on the fabric at the extreme edges of the fabric where the web will not interfere with the marks, or on the lower surface of the fabric, no changes need be made to the paper forming process and there is no effect on the utilization of the papermaking equipment.

Further objects, features and advantages of the invention will be apparent from the following detailed description when taken in conjunction with the accompanying drawings.

DETAILED DESCRIPTION OF THE INVENTION

Figure 1:
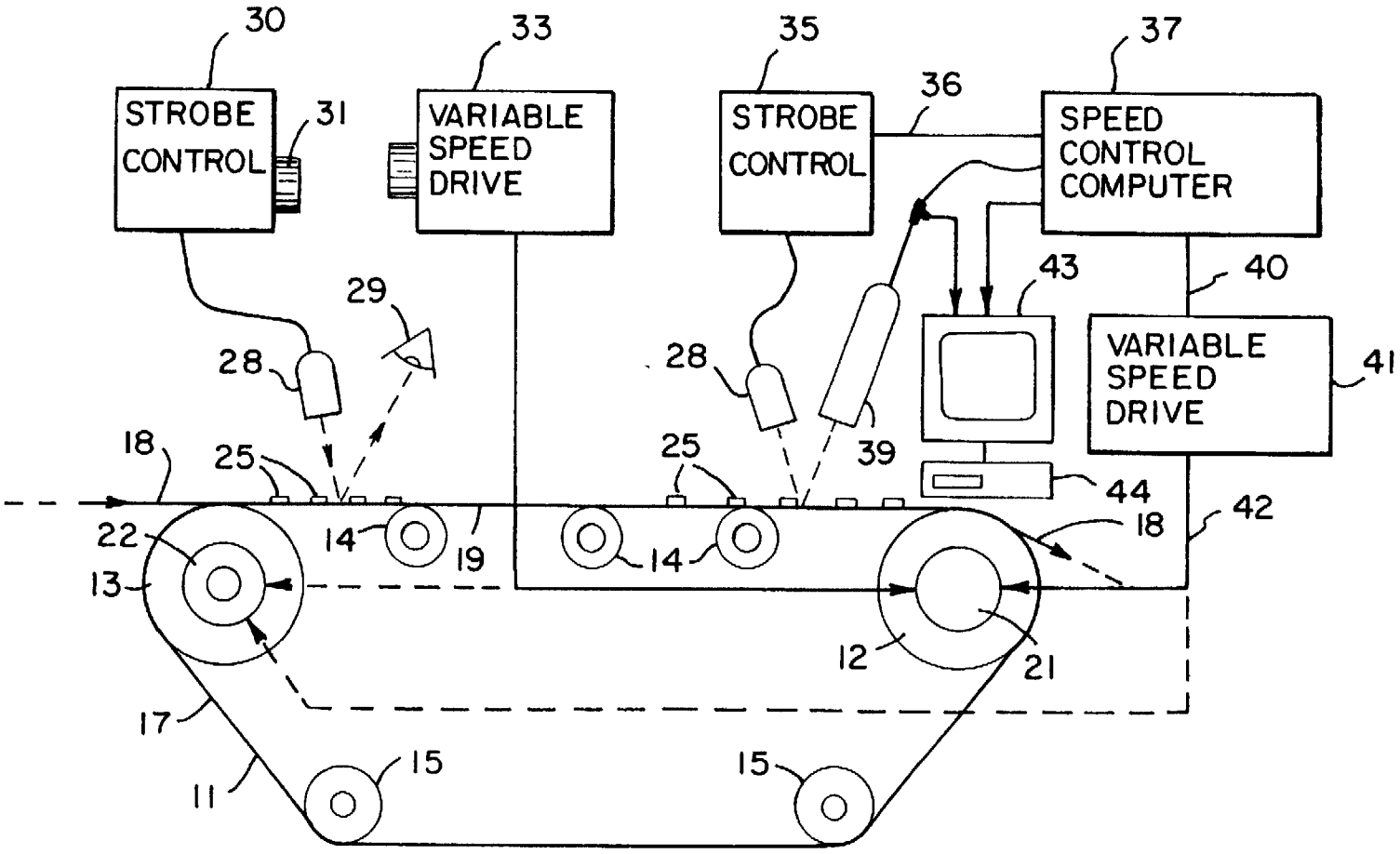
FIG. 1 is a simplified schematic view of a web contact fabric mounted on rollers in a papermaking machine, illustrating the positioning of the strobe light and observer or detectors in accordance with the present invention.

With reference to the drawings, the present invention is illustrated in conjunction with papermaking equipment shown illustratively in general form at 10 in FIG. 1. This equipment includes an endless loop of web contact fabric 11 engaged by drive rollers 12 and 13 and various support, idler and tensioning rollers and/or foils and vacuum boxes, illustratively shown at 14 and 15. As used herein, the term "fabric" is intended to encompass any of the loops of various types of materials that engage the web in the papermaking process, including Fourdrinier wire screens, other forming fabrics, press felts, and drier felts. It is understood that the arrangement of the loop of fabric 11 and the various rollers, etc., 12–15 is shown in FIG. 1 only for illustrative purposes, and any arrangement of drive and support rollers may be utilized. In the arrangement of FIG. 1, the fabric 11 has an upper or outer side 17 which engages and supports a web 18 of, e.g., pulp, and a lower or inner side 19 which is opposite to the side 17 that engages the web 18. The end roller 12 is typically driven by a drive motor 21, which is capable of variable speed operation. The drive motor 21 may be a mechanical driver with a variable speed transmission or an electric motor, for example, a DC motor provided with variable DC voltage or a 3 phase AC synchronous or induction motor that is provided with variable frequency power from a variable speed drive such as an inverter. The other rollers 13–15 may be freely rotating idler and tensioning rollers or may also be driven by helper motors synchronously with the motor 21. For example, the roller 13 (or other rollers) may also be driven by a drive motor 22, which may or may not be the same type as the drive motor 21. If the drive motors 21 and 22 do not operate so that the rotation of the rollers 12 and 13 is precisely synchronized, the fabric 11 may slip with respect to one or both of these rollers. Further, various factors, including elastic stretching of the fabric between the rollers 12 and 13, can result in a harmonic variation in fabric speed that also can detrimentally affect the quality of the formed paper. It is understood that the foregoing description of the papermaking equipment 10 is entirely illustrative, and any other arrangement of drive rollers and supports and loops of fabric 11 may be utilized.

Figure 2:
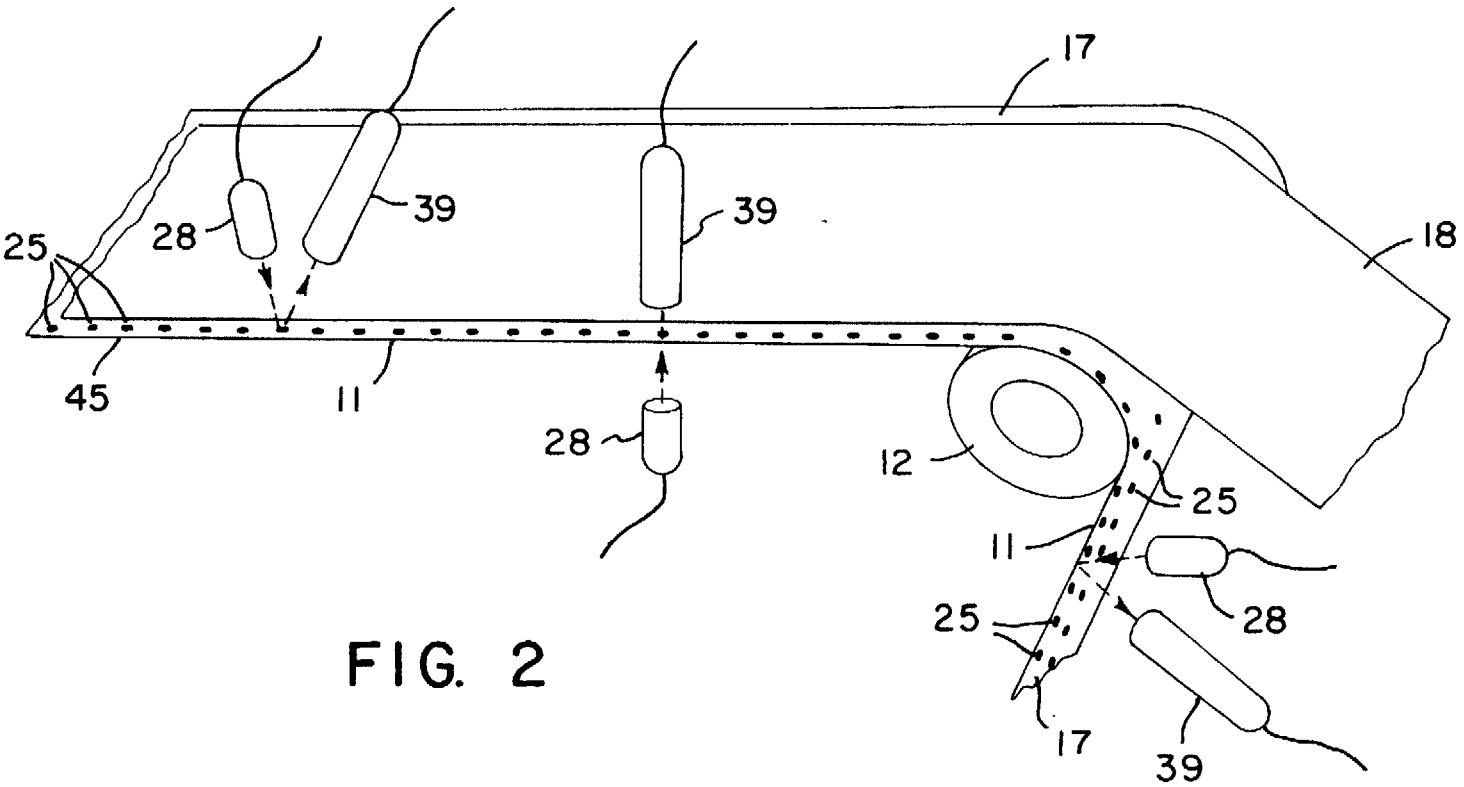
FIG. 2 is a simplified perspective view of a portion of a fabric having regularly spaced marks formed thereon in accordance with the invention.
Figure 3:
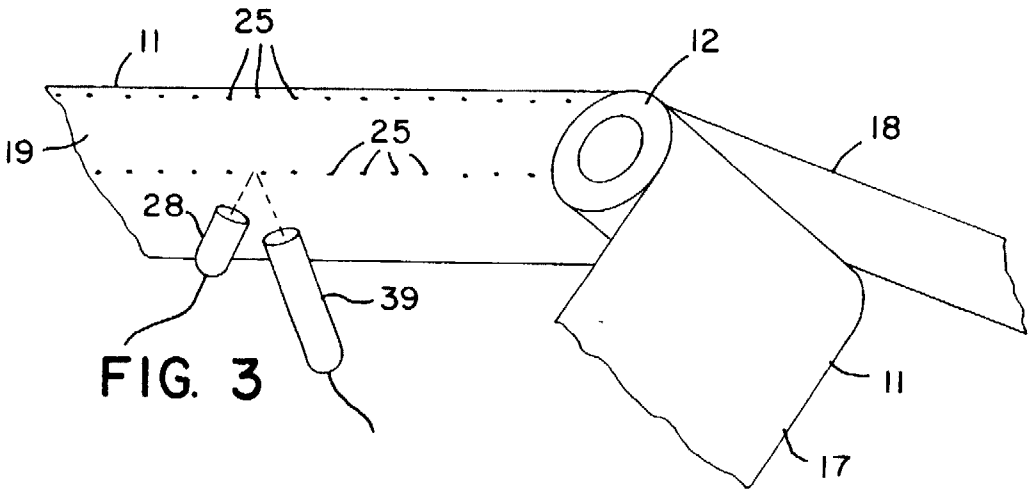
FIG. 3 is a perspective view of a portion of a fabric having regularly spaced marks formed on the inner surface of the fabric.
Figure 5:
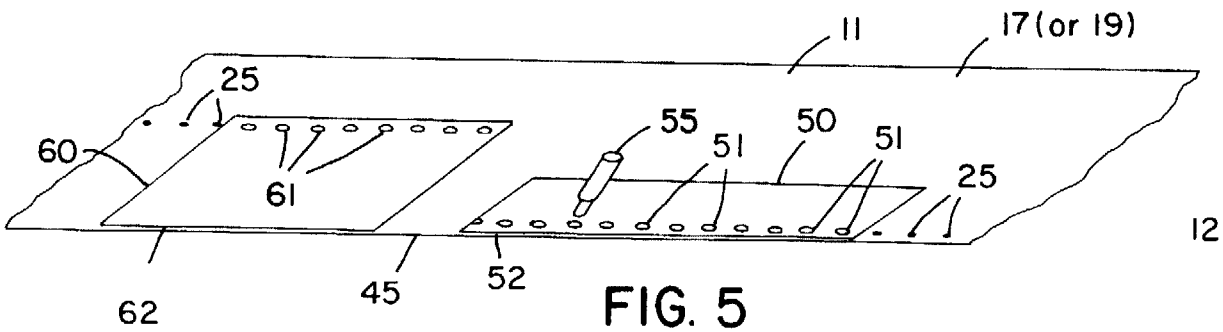
FIG. 5 is a perspective view of a section of fabric illustrating the application of marks to a fabric.

In the present invention, uniformly spaced optically detectable marks 25 are placed in a row in the direction of motion of the loop of fabric 11 at a desired position on either the outer surface 17 or the inner surface 19, as best shown in the perspective views of FIG. 2, 3 and 5. The marks 25 are illustrated in the side view of FIG. 1 and are shown as raised marks therein for illustrative purposes only. The optically detectable marks 25 are formed to have an optical appearance which clearly contrasts with the adjacent surfaces 17 or 19 of the fabric 11. The rate at which the marks 25 pass by a particular fixed point as the loop of fabric 11 is driven allows the speed of the fabric 11 to be determined in accordance with the present invention.

Measurement and/or adjustment of the speed of the loop of fabric 11 may be carried out utilizing simple and inexpensive equipment. As illustrated in FIG. 1, a stroboscope or strobe light 28, which puts out pulses of light at a selectable frequency in a beam, is positioned to direct the light pulses to the position of the fabric 11 at which the marks 25 pass by. An observer 29 may observe the marks 25 as illuminated by the beam from the strobe light 28, and when the pulses of light from the strobe light are synchronized to the speed of the fabric 11 so that each mark 25 is illuminated by a pulse of light from the strobe 28 at the same position, the speed of the fabric loop 11 can be determined from the frequency of the strobe light pulses and the known spacing of the marks 25. The observer 29 can adjust a strobe controller 30 by adjusting a control knob 31 until the illuminated marks 25 appear stationary. The strobe control 30 can display the frequency of the pulses at this point in time, thereby allowing the speed of the fabric 11 to be determined. Further, the observer can adjust the strobe pulse frequency by adjusting the strobe controller 30 to set a desired frequency and then operate an adjustable variable speed drive 33 which provides power to the drive motor 21 (and to the helper drive motor 22 if used) to adjust the speed of the fabric 11 until the marks 25 as illuminated by the strobe light 28 appear stationary. It is understood that a separate strobe light 28 and strobe controller 30 are shown in FIG. 1 for illustrative purposes, and that the strobe light and controller may be formed in single units.

If the illuminated marks 25 appear to drift forwardly or backwardly, or if the observed position of the illuminated marks 25 changes intermittently or periodically, a potential problem in the functioning of the papermaking equipment is indicated, as discussed above. If a systematic change in the speed of the fabric is observed, the operator can adjust the variable speed drive 33 until the marks now again appear to be stationary. In this way, the operator can control the speed of the fabric 11 directly to bring the fabric 11 to a desired nominal speed.

Measurement of the speed of the fabric 11 and/or control of the fabric speed can also be implemented automatically in accordance with the present invention, as also illustrated in FIG. 1. In this implementation of the invention, the strobe light 28 is connected to a strobe controller 35 which is connected by a communications link 36 to a speed control computer 37. The computer 37 receives a signal from an optical detector 39 which is directed to observe and receive light reflected from the position at which the beam from the strobe light 38 is projected onto the surface of the fabric 11. The signal from the optical detector 39, indicative of the apparent position of the marks as illuminated by the strobe light, is processed by the speed control computer 37 to control the frequency of pulses from the strobe light 28 through the control link 36 to the strobe controller 35 and/or to provide control signals on a line 40 to a variable speed drive 41 which provides drive power on lines 42 to the drive motor 21 (and the drive motor 22 when present). The implementation of the variable speed drive 41 will depend on the type of drive motor 21 driving the roller 12 (and the drive motor 22 for the roller 13). For example, a three phase variable frequency inverter may be used for the variable drive 41 wherein the motor 21 is a three phase synchronous or induction motor. Mechanical drives with variable transmissions can, for example, also be used. In some papermaking machines, the drive for one roller may be an electrical motor and a drive for an additional roller or rollers may be mechanical. The signal from the optical detector 39, as processed by the computer 37, provides a feedback signal which allows the computer 37 to control the speed of the motor 21 to drive the fabric 11 at a desired speed and to maintain the speed constant.

The optical detector 39 may be implemented in various ways, for example, as a photocell or photocells which provide an output signal that is related to the position of the marks 25 as illuminated by the pulses of light from the strobe light 28. In a preferred embodiment, the detector 39 comprises a video camera that provides video output signals to the speed control computer 37 that can be used by the computer 37 to ascertain the position of the marks 25 in the video frame as illuminated by the strobe light 28, as well as to detect any drifting of the position of the marks 25 from a desired nominal position. With this information, the speed control computer 37 can then provide output signals on the lines 40 to the drive 41 to control the motor 21 to increase or decrease the speed of the roller 12 to move the illuminated marks 25 as seen on each video frame until the marks reach a desired nominal position within the frame.

The video camera 39 may also provide an output video signal to a video monitor 43 to allow inspection by a human observer, allowing observer interaction and control of the process. The video monitor 43 may be used by the operator to visually observe the illuminated marks 25 in lieu of direct observation to detect speed variations and allow diagnosis of machine problems as discussed above. The video signal may also be recorded on, e.g., a video tape recorder 44 to record and allow inspection of the videotaped record over a long period of time. While commercial camcorders may be used for the video camera 39, high speed video cameras 39 are preferred and are commercially available. Examples of such video cameras include the HSC-500 ×2 High Speed Video Camera available from JC Labs, Inc. of Mountain View, Calif., the CID2250D Solid State Monochrome Video Camera available from CIDTEC of Liverpool, New York, the PULNiX TM-6701AN Video Camera and the TM-745E/TM-765E High Resolution CCD Camera, available from Subtechnique, Inc. of Alexandria, Va., and the VIDICHIP III JE7742A/JE7742AX Monochrome CCD Camera from Javelin Systems of Torrance, Calif.

Various alternative positions and arrangements of the marks 25 in cooperation with the strobe light 28 and the detector 39 are illustrated in FIGS. 2 and 3. As shown in FIG. 2, the marks 25 can be formed on the outer surface 17 of the loop of fabric 11 closely adjacent to one of the edges 45 of the fabric 11. The strobe light 28 can then be positioned to direct its beam toward the fabric 11 near the edge 45 so that the marks 25 will be illuminated, and the illumination of such marks will be observed by the detector 39 which is mounted in a position close to the marks 25 to detect the reflected light from the edge portion of the fabric 11. As is illustrated in FIG. 2, the width of the web 18 can be less than the width of the fabric 11 so that a portion of the outer surface 17 of the fabric 11 adjacent the edge 45 is not covered by the web 18.

As an alternative, also shown in FIG. 2, the strobe light 28 may be positioned and mounted above or below the fabric 11 (the strobe 28 is shown mounted below the fabric in FIG. 2) to project the pulsed beam of light through the fabric 11 at a position near the edge 45. A detector 39 is mounted on the opposite side of the fabric to receive the light passed through the fabric. The marks 25 then affect the transmission of the pulse beam from the strobe 28 through the fabric 11, and the position of the marks 25 can then be detected by the detector 39 by observing the variation in the transmitted light.

In a further alternative, also shown in FIG. 2, the strobe light 28 may be mounted to illuminate the marks 25 at a portion of the fabric 11 after the fabric has passed over the roll 12 so that it is completely uncovered by the web, and the detector 39 is mounted to receive the light reflected from the illuminated marks 25. When the strobe light 28 and detector 39 are mounted in such a position, it is seen that it is not necessary that the width of the web 18 be less than the width of the fabric 11, since the web 18 is out of contact with the fabric 11 at that position. As further illustrated in FIG. 2, the row of marks 25 can be positioned elsewhere on the surface of the fabric 11 than at the edge, and the strobe 28 and detector 39 can be mounted in a position to illuminate and observe the row of marks in such other position.

As illustrated in FIG. 3, the row of marks 25 can also be positioned on the inner surface 19 of the fabric 11, with the strobe light 28 and detector 39 then positioned to illuminate and detect the marks 25 formed on the inner surface 19.

It is thus seen that the strobe light 28 and the detector 39 can be positioned to illuminate and detect the marks 25 at a variety of positions on the fabric 11 (including positions at which the fabric 11 is in contact with the roll 12 or with one of the other rollers) and can be mounted so as to have the detector 39 receive reflected light from the strobe light 28 that illuminates marks on the surface of the fabric or to receive light from the strobe light 28 that has passed through the fabric.

Figure 4:
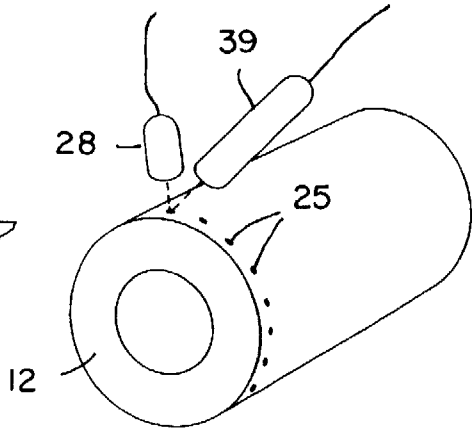
FIG. 4 is a perspective view of a roller having regularly spaced marks formed thereon in accordance with a further embodiment of the invention.

As shown in FIG. 4, the present invention may be used to measure the speed of the rollers, such as the roller 12 shown in FIG. 4, by placing a row of uniformly spaced optically detectable marks 25 on a surface of the roller (e.g., at an edge as shown in FIG. 4, although other positions may be utilized that are not covered by the fabric 11, including the side of the roller). A measurement may be made of the speed of the drive roller by directing the beam from the strobe light 28 to the position of the marks 25 and observing the illuminated marks 25 either directly or with a detector 39.

It is a particular advantage of the present invention that the optically detectable marks 25 may be placed on the fabric 11 without interfering with the performance of the fabric in any way. Further, the marks 25 may be placed on already mounted fabrics without requiring that the fabrics be removed from the papermaking machine. An illustrative example of a method of placement of the marks 25 on a fabric 11 is shown in FIG. 5. Precise location of the marks 25 can be accomplished using a template 50, e.g., formed of a sheet of metal or plastic, which has holes 51 formed therein (such as by drilling into the sheet material of the template 50) at precisely uniformly spaced positions which are also spaced precisely with respect to an edge 52 of the template 50. To form the marks 25 on the outer surface 17 or the inner surface 19 of the fabric 11, the template 50 can be placed on the surface 17 or 19 with the edge 52 of the template aligned with the edge 45 of the fabric 11. The marks 25 can then be formed by applying a marking material through the holes 51, e.g., paint or ink (e.g., from a permanent ink felt tip marker illustratively shown at 55). When all of the marks 25 have been formed using the template 50, the template can then be moved into a new position in which the last mark 25 is aligned with either one end of the template 50 or with one of the holes 51, and with the edge 52 of the template again aligned with the edge 45 of the fabric 11.

To form a row of marks 25 at a position spaced a significant distance from the edge 45, a template 60 similar to the template 50 may be used, also formed of sheet material and having a row of holes 61 formed therein at positions spaced a significant distance from an edge 62 of the template 60. The template 60 is used in the same manner as the template 50, with the edge 62 being aligned with the edge 45 of the fabric 11 and with ink, paint or other marking material applied through the holes 61 in the template to mark the surface of the fabric.

By monitoring the speed of the fabric 11 in accordance with the invention, and correcting the source of speed variations that are detected, significant improvements in the papermaking process can be obtained. As an example, where the fabric 11 is the forming wire on which the pulp slurry is deposited to form the web, and measurement of fabric speed in accordance with the invention shows intermittent or harmonic variation in fabric speed indicative of fabric slipping, adjustment, repair or replacement of the roller drives may be indicated. The correction of machine problems diagnosed in this manner can provide a significant decrease in wear of the wire where slippage has been occurring and a reduction in the variability of the basis weight of the paper made using such equipment.

As an example, the present invention was utilized on a papermaking machine having a Scappa single ply Ultraform #12721 forming wire that operates in the range of 525 to 1500 feet per minute (FPM) with an average speed at the reel of 1000 FPM. The marks 25 were placed on the forming wire using an Avery-Dennison "Marks-A-Lot" permanent felt tip marker. The marks were circular marks ½ inch in diameter spaced 1.25 inches apart. The marks were applied using a six foot long template made from flat sheet plastic laminate having the appropriate hole size and spacing to form the desired marks. Such marks were readily detected and used to monitor the speed of the machine using a Unilux model 8857 strobe light, allowing detection of speed variations due to fabric slipping.

In general, the size and spacing of the marks 25 is selected so that small and/or short term variations in speed can be detected. Mark size of less than one inch and mark spacings of less than two inches will typically be suitable, but the size and spacing of the marks may be appropriately chosen based on the nominal speed of the fabric and other machine conditions. The relatively close spacing of the marks allows essentially continuous monitoring of the speed of the web. The present invention thus has the ability to detect very short term changes in speed, even transient changes in speed that occur over a fraction of a second since the speed changes will result in an observable displacement of the illuminated marks. Because of the essentially discrete sampling of the position of the marks by the strobe light, the measurement of speed obtained by the invention is not only extremely sensitive but also largely immune to noise.

It is understood that the invention is not confined to the particular embodiments set forth herein as illustrative, but embraces all such modified forms thereof as come within the scope of the following claims.

What is claimed is:

1. A method of measuring the speed of a loop of flexible fabric used in papermaking comprising the steps of:

(a) providing spaced optically detectable marks in a row on the fabric aligned in the direction of motion of the fabric, the optically detectable marks spaced in the row a uniform distance apart;

(b) driving the loop of fabric in motion;

(c) directing a beam from a strobe light at a position on the fabric at which the row of optically detectable marks pass by, the strobe light providing pulses of light at a selected frequency; and (d) observing the marks as illuminated by the strobe light whereby the frequency of the strobe light pulses or the speed of the motion of the loop of fabric or both may be adjusted to synchronize the light pulses with the position of the marks on the moving fabric as they pass by the beam of the strobe light, and whereby variations in fabric speed result in variations in the position of the marks as illuminated by the strobe light.

2. The method of claim 1 including the step of adjusting the frequency of the pulses of light from the strobe light until the observed marks on the fabric as illuminated by the strobe light appear to be stationary.

3. The method of claim 1 including the step of adjusting the speed of the fabric until the marks on the fabric as illuminated by the strobe light appear to be stationary.

4. The method of claim 3 wherein the loop of fabric is engaged by rollers including a roller which is driven by a motor supplied with power from an adjustable speed drive, and wherein the step of adjusting the speed of the loop of fabric is carried out adjusting the power provided by the variable speed drive to the motor driving the roller.

5. The method of claim 1 wherein the loop of fabric is selected from the group of fabrics consisting of Fourdrinier forming wires, drier felts, and press felts.

6. The method of claim 1 including the additional step of providing a row of spaced marks on a roller engaged with the loop of fabric, the spaced marks formed on the roller in a row in the direction of rotation of the roller with a uniform distance between each of the marks, and including the step of directing a beam from a strobe light providing pulses of light at a position on the roller at which the row of spaced marks on the roller pass by, and adjusting the frequency of the pulses of light from the strobe light until the marks as illuminated by the strobe light are observed to appear to be stationary, whereby the surface speed of the roller can be determined.

7. The method of claim 1 wherein the step of observing the marks is carried out by directing a video camera at the position of the marks and displaying the video image from the camera on a video monitor for view by an observer.

8. Apparatus for controlling the speed of a loop of fabric in a papermaking machine, the fabric supported by rollers at least one of which is a drive roller driven by a motor supplied with power from a variable drive so that the speed of the motor is controllable, wherein the fabric has a row of optically detectable marks formed thereon aligned in the direction of motion of the fabric, the marks spaced a uniform distance apart, comprising:

(a) a strobe light that produces a beam of light pulses at a selectable and controllable, the strobe light positioned so the beam from the strobe light is directed to a position on the fabric at which the row of spaced marks passes by;

(b) an optical detector mounted to receive light from the fabric at the position at which the row of marks is illuminated by the strobe light, the detector providing an output signal indicative of the apparent position of the marks as illuminated by the strobe light; and (c) controller means for receiving the output signal from the detector and providing a control signal to a variable speed drive for the motor driving the driven roller to adjust the speed of the driven roller until the marks as illuminated by the strobe light and detected by the detector appear substantially stationary to thereby control the actual speed of the fabric.

9. The apparatus of claim 8 wherein the detector comprises a high speed video camera which provides an output video signal indicative of a video frame and wherein the controller provides output signals to the variable drive to control the speed of the motor driving the driven roller so that the position of the marks as illuminated by the strobe light and detected by the video camera detector appear stationary within each video frame.

10. The apparatus of claim 8 wherein the strobe light and the detector are positioned on the same side of the fabric so that the detector receives light from the strobe light which is reflected from the surface of the fabric.

11. The apparatus of claim 8 wherein the strobe light and the detector are positioned on opposite sides of the fabric so that the detector receives light from the strobe light that passes through the fabric.

12. Apparatus for monitoring the speed of a loop of fabric in a papermaking machine supported by rollers at least one of which is a driven roller comprising:

(a) a row of optically detectable marks formed on the fabric aligned in the direction of motion of the fabric, the marks spaced a uniform distance apart;

(b) a strobe light that produces a beam of light pulses at a selectable and controllable frequency, the strobe light positioned so the beam from the strobe light is directed to a position on the fabric at which the row of spaced marks passes by;

(c) a video camera detector mounted to receive light from the fabric at the position at which the row of marks is illuminated by the strobe light, the detector providing an output video signal indicative of the apparent position of the marks as illuminated by the strobe light; and (d) a video monitor receiving the video signal from the detector and displaying the video image of the marks illuminated by the strobe light.

13. The apparatus of claim 12 wherein the strobe light and the detector are positioned on the same side of the fabric so that the detector receives light from the strobe light which is reflected from the surface of the fabric.

14. The apparatus of claim 12 wherein the strobe light and the detector are positioned on opposite sides of the fabric so that the detector receives light from the strobe light that passes through the fabric.

* * * * *